US005423093A

United States Patent [19]

Hall-Vandis

[11] Patent Number: 5,423,093

[45] **Date of Patent: * Jun. 13, 1995**

[54] PROTECTIVE INFLATABLE EDGE GUARD FOR USE WITH SWIMMING POOL STRUCTURAL COMPONENTS

[76] Inventor: Nancy Hall-Vandis, 4730 Laurel Grove Ave., North Hollywood, Calif. 91607

[ * ] Notice: The portion of the term of this patent subsequent to Aug. 4, 2009 has been disclaimed.

[21] Appl. No.: 840,962

[22] Filed: Feb. 24, 1992

Related U.S. Application Data

[63] Continuation-in-part of Ser. No. 545,815, Aug. 6, 1990, Pat. No. 5,134,730.

[51] Int. Cl.[6] ..... E04H 4/00

[52] U.S. Cl. ..... 4/504; 4/496; 5/663

[58] Field of Search ..... 4/494, 496, 504, 580, 4/DIG. 18; 206/522; 383/4; 150/154, 165; 5/455, 644, 663, 922

[56] References Cited

U.S. PATENT DOCUMENTS

| | | | |
|---|---|---|---|
| 2,152,968 | 4/1939 | Monge | 4/580 |
| 2,600,556 | 6/1952 | Malm | 5/663 X |
| 3,271,787 | 9/1966 | Clary | 4/504 |
| 3,429,085 | 2/1969 | Stillman | 4/504 |
| 3,892,000 | 7/1975 | Morse | 4/580 |
| 3,931,652 | 1/1976 | Navarra | 4/580 X |
| 4,037,591 | 7/1977 | Sarno | 5/922 X |
| 4,514,871 | 5/1985 | Fisher et al. | 5/663 |
| 4,630,323 | 12/1986 | Sage et al. | 4/580 |
| 4,709,429 | 12/1987 | Lerner et al. | 4/DIG. 18 X |
| 4,841,586 | 6/1989 | Juster et al. | 5/663 |
| 4,876,755 | 10/1989 | Parrish | 5/922 X |
| 4,998,311 | 3/1991 | Ernst | 5/455 |
| 5,040,252 | 8/1991 | Taggart | 4/580 |
| 5,042,663 | 8/1991 | Heinrich | 206/522 |
| 5,081,725 | 1/1992 | Neese | 5/663 X |

FOREIGN PATENT DOCUMENTS

| | | | |
|---|---|---|---|
| 1210065 | 7/1960 | France | 5/455 |
| 3134256 | 3/1983 | Germany | 4/580 |
| 2194883 | 3/1988 | United Kingdom | 5/644 |

*Primary Examiner*—Charles E. Phillips
*Attorney, Agent, or Firm*—Robert J. Schaap

[57] ABSTRACT

A protective inflatable edge guard which is provided to extend around the deck of a swimming pool adjacent the edge of the deck at the swimming pool and along edges of structural components or members associated with the pool. The edge guard thereby provides protection to swimmers and others using the swimming pool by precluding hard contact with said edges. The protective edge guard is comprised of a plurality of inflatable tubes which are sized and shaped to extend around the edges of the swimming pool deck and structural components thereof. Moreover, the individual tubes are endwise abuttable to form a generally peripherally extending edge liner. A member is provided on the inflatable tubes to hold the endwise abutted inflatable tubes along the edge of the swimming pool deck. The protective edge guard of the present invention is also highly effective for use on those structural components associated with the swimming pool, as aforesaid, such as for example, a driving board, a ladder, a slide, steps of the pool and the like.

6 Claims, 3 Drawing Sheets

PROTECTIVE INFLATABLE EDGE GUARD FOR USE WITH SWIMMING POOL STRUCTURAL COMPONENTS

RELATED APPLICATION

This application is a continuation-in-part application based on my U.S. patent application Ser. No. 545,815, filed Aug. 6, 1990 entitled "Pool Deck Protective Liner" (now U.S. Pat. No. 5,134,730, issued Aug. 4, 1992).

BACKGROUND OF THE INVENTION

1. Field of the Invention

This invention relates in general to certain new and useful protective guards for use with swimming pools and structural components associated therewith, and more particularly to an inflatable edge guard which extends around the edge of a pool deck adjacent a swimming pool and around edge and corner portions of the components used at or in a swimming pool to preclude contact with edges and corners and thereby prevent resultant injury to a swimmer.

2. Brief Description of the Prior Art

It is well known that children and even adults oftentimes scrape parts of their body when engaging the edge of a pool deck. Oftentimes, and particularly, children will attempt to climb out of a swimming pool using the edge of the deck for support. In so doing, it is common place for these children to scratch and abrade arms and legs and the like.

While the scratches and abrasions which may result from engagement of a pool deck at the edge thereof are not usually of a serious nature, there have been many occasions in which children and even adults will accidentally knock a portion of their body into the edge of the pool deck. Chipping of a tooth and head injuries oftentimes can result from any inadvertence in attempting to climb out of a swimming pool or merely playing in the swimming pool adjacent the edge thereof at the deck.

The above and other injuries could easily be avoided by the provision of some form of protective guard which extends around the periphery of the swimming pool deck at the edge thereof and around the structural components such as ladders and diving boards. However, heretofore, there has not been any effective swimming pool protective guard which is portable and relatively low in cost but which is highly effective in precluding injuries which are often occasioned at the edge of a swimming pool deck.

The same problems which arise when a swimmer contacts an edge of a pool deck can arise as easily when the swimmer contacts a component of that pool and particularly, the so-called "structural components" which include, for example, a ladder which is secured to the deck and extends into the water, steps forming part of that pool base, a diving board and like components or members. In this case, swimmers often swim into and contact the edges of the rungs of a ladder or the poles supporting the rungs. If the poles should have any sharp edges, or even corner portions, the swimmer can easily be injured. In like manner, the rungs of the steps are almost always formed with corner portions which can easily cause injury if inadvertently contacted. The same holds true with edges of diving boards, steps and like components.

Heretofore, there has not been any effective protective inflatable guard which is relatively low in cost, but which can be used on the pool structural components and which are effective in precluding injuries often occasioned when a swimmer inadvertently contacts these components.

OBJECTS OF THE INVENTION

It is, therefore, one of the primary objects of the present invention to provide a protective inflatable guard which extends around the periphery of a swimming pool deck.

It is also an object of the present invention to provide a protective inflatable guard which is capable of extending around the periphery of a diving board or the steps or rails of a ladder or other structural component forming part of a swimming pool construction.

It is an additional object of the present invention to provide a protective inflatable guard which may be adapted to extend around corner portions of components used at or in a swimming pool.

It is another object of the present invention to provide a protective inflatable guard of the type stated which is comprised of a plurality of endwise abuttable and inflatable tubes.

It is a further object of the present invention to provide a protective inflatable guard of the type stated in which each of the inflatable and endwise abuttable tubes are provided with a valve means for purposes of inflating and deflating the tubes.

It is still another object of the present invention to provide a protective inflatable guard of the type stated which is provided with a holding means for securing the tubes in their endwise abutted relationship around the edge of the swimming pool deck or other structural components used therewith.

It is still a further object of the present invention to provide a protective inflatable guard of the type stated which can be constructed at a relatively low cost and which is thereby easily affordable but which also is highly effective in use.

It is yet another important object of the present invention to provide a protective inflatable guard of the type stated which is light in weight, sturdy in construction and easily stored and repositioned on various structural components used at or adjacent to swimming pools and on the edges of the decks of swimming pools.

With the above and other objects in view, my invention resides in the novel features of form, construction, arrangement and combination of parts presently described and pointed out in the claims.

BRIEF SUMMARY OF THE INVENTION

A protective inflatable guard to extend around the deck of a swimming pool adjacent the edge of the deck at the swimming pool. This protective guard also serves as, and can be used as, a pool component protective guard, that is, a cushioning element which is adapted to extend over and around portions of components such as structural components forming part of or used in a swimming pool. The protective guard comprises a plurality of tubes which are capable of being inflated.

The protective guard of the present invention has been identified, on occasion, as a pool deck protective guard due to the fact that one of its important utilities may well lie in protecting against injuries at the edge of a swimming pool deck. However, the protective guard is not so limited and is capable of being used around other structural components associated with the swimming pool, as for example, on swimming pool ladders including both the steps and the rails of the ladders, and diving boards. Thus, the term "pool deck" is used in a generic sense to include all structural components of that pool deck including the ladder, slide, railings, and the diving board and any other structural additions to the pool and its surrounding area.

Each of the inflatable tubes is preferably inflated by air or other gas for purposes of convenience and ease of filling and also to provide a great degree of resiliency in the event that a user engages the tube with a relatively large amount of force or with any significant velocity which would otherwise result in severe injury. However, it should be understood that various fluids may be used for filling of the individual tubes. Thus, liquids such as water and the like can also be used as the tube filling medium. Further, small particulate matter which are capable of moving in the nature of liquids can also be employed as the tube filling medium. Thus, gases, liquid and particulate matter are encompassed by the term "fluid". In like manner, the term "inflate" is used in a broad sense to mean a filling of the tubes, whether with gas, liquid or solid particulate matter.

Each of the individual inflatable tubes has a length which is less than the overall length or the overall width of any edge of a swimming pool. Thus, relatively short tube sections are desirable for purposes of transport and storage while in the inflated condition. However, each of the individual tubes is adapted for endwise abutting engagement to extend fully around or otherwise around a substantial portion of the edge of the deck of a swimming pool.

Each of the inflatable tubes is preferably provided with valve means in which to inflate the tube or to deflate the tube. Further, means is connected to each of the tubes to hold the tubes in their endwise abutted position around the portion of the periphery of the swimming pool deck.

The tubes also have a configuration so as to extend around and engage an edge portion of the upper surface of the deck and a vertically disposed edge portion of the deck. In this way, the tubes are generally form-fitted around the edge of the deck. They will also provide protection against and preclude hard contact of the user against the edge of a swimming pool deck.

In a preferred embodiment of the present invention, each of the tubes has an upper lip section which extends around a corner of the edge of the deck and a lower section which extends downwardly over vertically disposed section of the deck.

The means for holding the plurality of tubes in their endwise abutted relationship may comprise a web attached to the tubes with a chamber having a heavy particulate matter therein and which chamber is connected to the web in order to hold the tube on the deck. In another embodiment of the invention, the means for holding the tubes could comprise Velcro strips on the tubes for engaging a deck surface or otherwise for engaging a similar Velcro strip on the upper surface of the pool deck. In this latter embodiment, one Velcro strip would be secured to each tube as for example, by adhesive attachment and a mating Velcro strip would be secured to the upper surface of the pool deck also by an adhesive attachment.

In another embodiment of the invention, it is possible to provide the inflatable protective guard in an uncut roll of elongate tubes. In this way, the user of the pool deck protective guard can cut segments from the roll to the desired length and seal the edges thereof, oftentimes by any convenient source of heat, such as a steam iron or the like. In this way, inflatable tubes can easily be formed by the user.

The invention also discloses the utility of using the same protective guard on components of the swimming pool of the type previously described. In this case, a plurality of inflatable tubes can be located on the edges of a diving board or edges of a slide for protecting the user from inadvertent hard contact with the edges of the diving board or the slide. The same inflatable guards could also be used on the rails of a ladder. A single guard might be used on each rung of the ladder.

The inflatable tubes which are used for disposition at corner portions of the structural components would essentially adopt the same construction as the protective guard used at the edge of a pool deck and would also be inflated and deflated in the same manner.

In a preferred embodiment, and considering the use of the protective guard around a portion of a structural component, this protective guard protects a swimmer from a hard contact against a portion of that structural component, and which structural component usually has relatively hard surfaces lying in mutually angular planes. In this case, the protective guard comprises a plurality of inflatable tubes capable of being inflated with a fluid which is adapted for endwise abutting engaging with one another to extend around a portion of the structural component at that swimming pool.

A valve means is located on each of the tubes to inflate the tubes with a fluid and to deflate the tubes. Further, means is connected to each of the tubes to hold them in endwise abutted position with one another when the tubes extend around the edge of the structural member at the swimming pool. These tubes further will have a configuration when inflated to effectively wrap around the angular surfaces of the structural component and any edge between the angular surfaces so as to extend over a first surface of the structural member and an angularly located second surface of the structural member. The inflated components will also extend over an edge portion of this structural member.

In accordance with the above construction, the angulated surfaces of a constructrual component and the hard surfaces thereof with which a swimmer could impact against are covered by the resilient inflatable tubes. Thus, these tubes will absorb the force of an impact by a swimmer thereby providing protection to the swimmer and precluding hard contact of the swimmer against any portion of the structural member.

This invention has many other purposes and has other advantages which will be made more fully apparent from a consideration of the forms in which it may be embodied. One of these forms of the unique and novel protective guard is disclosed in the following detailed description of the invention. However, it should be understood that this detailed description is set forth only for purposes of illustrating the general principles of the invention but is not to be taken in a limiting sense.

BRIEF DESCRIPTION OF THE DRAWINGS

Figure 1:
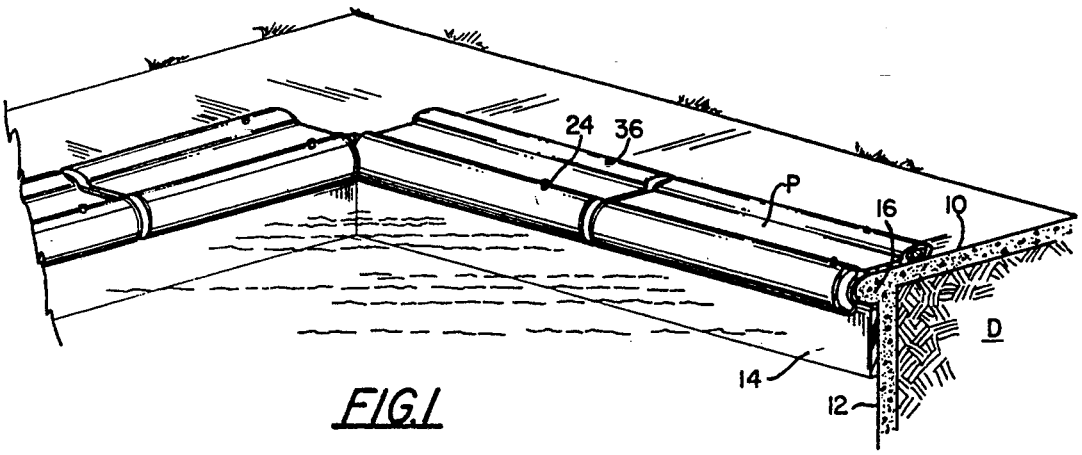
Figure 2:
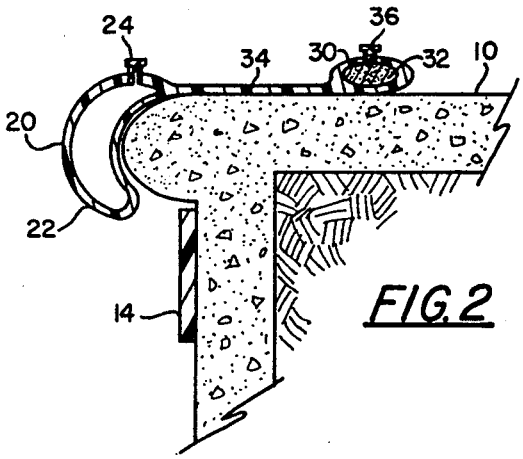
Figure 3:
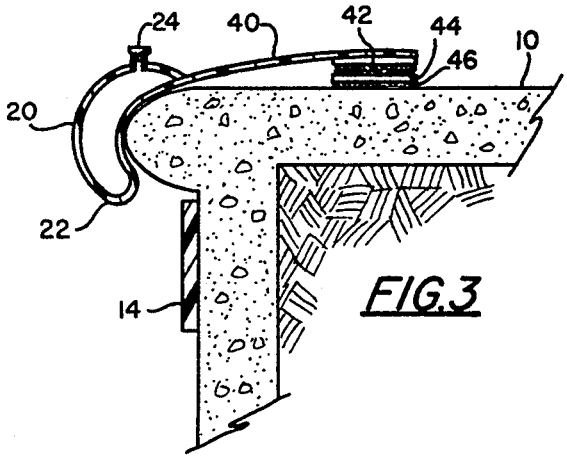
Figure 4:
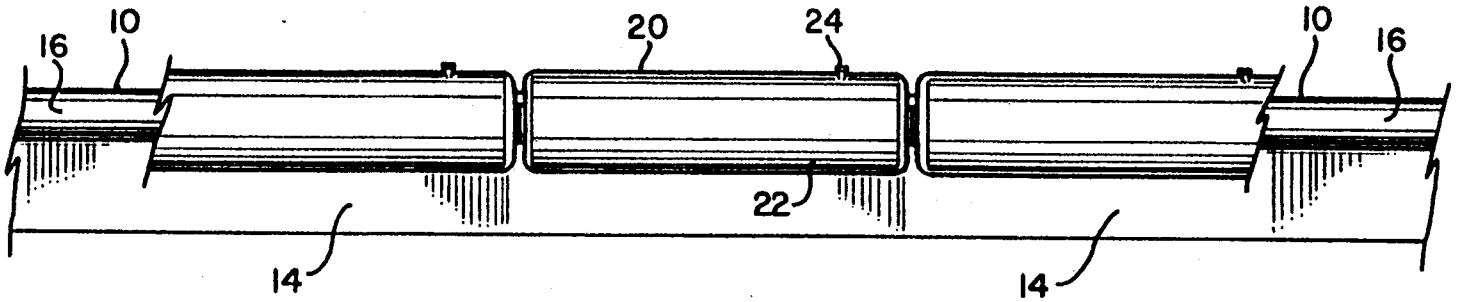
Figure 5:
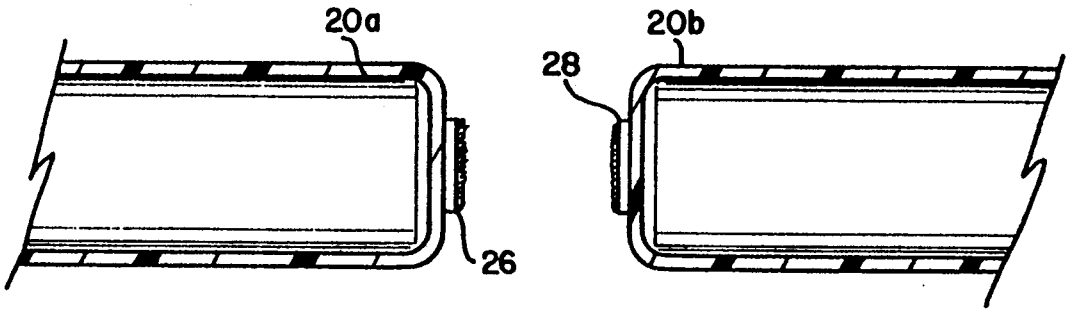
Figure 6:
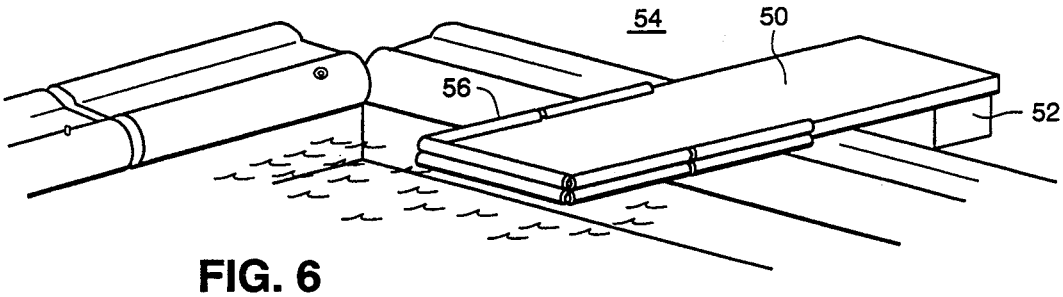
Figure 7:
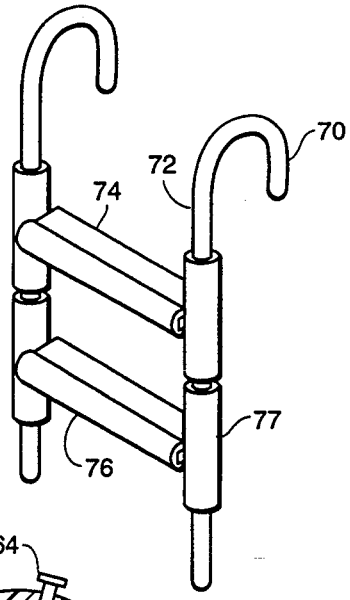
Figure 8:
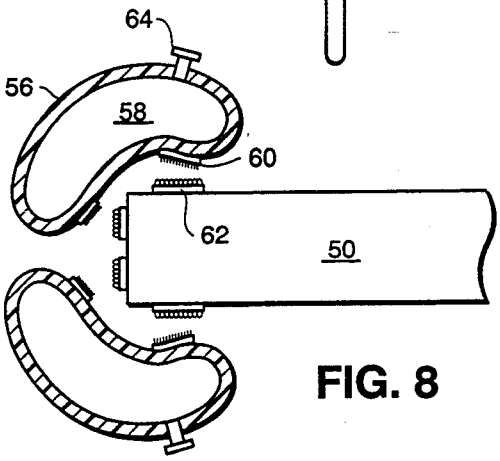
Figure 9:
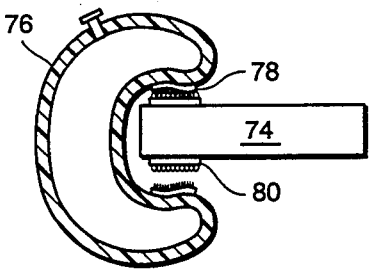
Figure 10:
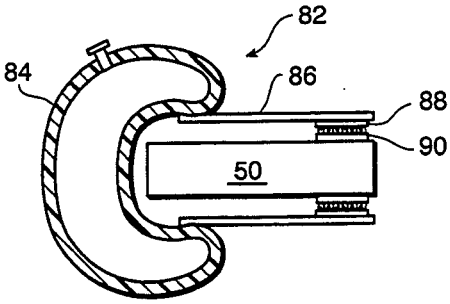

Having thus described the invention in general terms, reference will now be made to the accompanying drawings (three sheets) in which:

FIG. 1 is a fragmentary view broken away and showing the use of one embodiment of the inflatable protective guard in connection with the edge of a pool deck;

FIG. 2 is a vertical sectional view showing the protective guard adjacent the edge of a deck of a swimming pool;

FIG. 3 is a vertical sectional view, somewhat similar to FIG. 2 and showing an alternate means of holding the protective guard adjacent the edge of a swimming pool;

FIG. 4 is a fragmentary elevational view showing a plurality of protective guards in endwise abutted engagement around the deck of a swimming pool;

FIG. 5 is a fragmentary sectional view showing a means for attaching a pair of endwise abuttable protective guard sections;

FIG. 6 is a fragmentary perspective view showing the use of the protective guard on a diving board;

FIG. 7 is a fragmentary perspective view showing the protective guard on the poles and rungs of a pool ladder;

FIG. 8 is a side elevational view, partially broken away and in section, and showing the protective guards on the front edges of a diving board;

FIG. 9 is a fragmentary side elevational view, partially in section, and showing the protective guard on the front edge of a ladder rung; and FIG. 10 is a side elevational view, partially in section, and showing a modified form of protective guard used on the ladder rung.

DETAILED DESCRIPTION OF A PREFERRED EMBODIMENTS

Referring now in more detail and by reference characters to the drawings which illustrate a preferred embodiment of the present invention, D designates the deck of a swimming pool having an upper deck surface 10 and a vertically disposed pool wall 12, as shown in FIG. 1. Many conventional swimming pools are provided with an upper section of decorative tile 14 adjacent the upper edge thereof.

Many swimming pools are provided with a vertically disposed wall which merges into a horizontal deck at a sharp corner. However, in a more preferred construction, many swimming pools are provided with a somewhat rounded corner 16.

A protective guard P of the present invention is shown in one embodiment in FIGS. 1 and 2. In this case, the protective guard P is comprised of a plurality of individual endwise abutted tubes 20 as shown in FIG. 4. Each of these tubes have a hollow interior chamber 22 capable of being filled with air or other suitable gas by means of an openable and closable inlet valve 24. However, as indicated above, other tube filling mediums may be employed and include for example liquids and finely divided solid particulate matter. Valves of these types are conventional and typically are found in air-framed waterbeds.

In the embodiment as illustrated in FIG. 4, each of the individual tubes 20 are endwise abutted against one another. Moreover, each of the tubes 20 has a length which is less than the overall length or overall width of any edge of the swimming pool. In this way, they are conveniently adapted for storage and transport in small packages. Further, a large number of the individual tubes could be packaged in a single light-weight container for transport or storage.

The individual tubes 20 may be connected together at their ends by means of Velcro strips. FIG. 5 illustrates an embodiment where one protective tube **20*a* is provided with a Velcro strip 26 containing hook-like fiber fasteners 26. Another protective tube 20*b* is provided with a Velcro strip 28** containing loop-type fiber fasteners forming part of the Velcro arrangement. In this way, individual tubes may be endwise abutted against each other and held in position by means of the Velcro strips.

Each of the tubes 20 is also held adjacent the edge of the swimming pool deck, in the embodiment as illustrated in FIGS. 1 and 2, by means of weighted cylindrical tubes 30. In this case, each of the cylindrical tubes 30 is provided with a particulate matter such as sand 32 on the inner surface thereof. These holding cylinders or tubes 30 merely lie against the upper surface of the deck of the swimming pools and are retentively held by their weight. In addition, each of the tubes 20 is connected to the holding cylinders by means of a flexible plastic web 34.

In accordance with this construction, the user of the pool deck protective guard assembly may position a plurality of endwise abutted tubes adjacent the edge of the deck of a swimming pool. Each of the tubes 20 may then be inflated through the inlet valves 24. In addition, sand or other particulate matter of substantial weight is then introduced into the cylinders 30. For this purpose, each of the cylinders 30 may be provided with an upper opening plug 36 which may be removed for purposes of introducing the sand or the particulate matter into the holding cylinders and replaced after filling is completed.

FIG. 3 illustrates an embodiment of the invention which utilizes an alternate form of securing the protective guard to the deck of the swimming pool. In this embodiment, each of the individual inflatable tubes 20 is provided with a web 40 which is, in turn, provided with a Velcro strip 42 at its outer end. This Velcro strip 42 is adapted to engage a mating Velcro strip 44, the latter of which may be attached to the upper surface of the deck of the swimming pool by any suitable means. In the embodiment as illustrated in FIG. 3, the mating Velcro strip 44 is secured to the deck upper surface 10 by means of an adhesive layer 46. However, the Velcro strip 44 could be secured to the upper deck surface by means of implanting the same in the concrete deck, or otherwise securing the same to wooden or other material strips which are, in turn, nailed to the concrete deck or the like. In effect, any means for holding the mating Velcro strip 44 on the deck may be employed.

It should also be understood that other forms of releasably attaching the strip 42 to the strip 44 may be employed and need not be in the form of Velcro-type strips. Thus, strips having adhesive layers may also be employed for releasably attaching the strip 44 to the strip 42. Other means for securing the protective guard to the surface of a swimming pool deck or other components thereof may be employed. For this purpose, the so-called "Pop-it" beads may be employed. These Pop-it beads generally comprise a system of beads with each having prong-like projection capable of extending into a prong receiving recess on an adjacent bead. Other means for attachment include tracks which are secured to the pool deck and have recesses to receive runners on the underside of the individual tubes. These runners and for that matter, the tracks themselves may also be formed of extrudable plastics.

In a preferred embodiment, the individual inflatable tubes 20 are each C-shaped and are about six feet long. However, the length could vary in order to achieve a desired length of convenience for both use and packaging. Moreover, the Velcro strips or other holding cylinders 30 are sufficiently narrow and they do not interfere with or provide any obstruction to the use of the pool. Nevertheless, they do provide a sufficient gripping surface for individuals who prefer the safety of hanging onto the edge of a swimming pool.

The individual lengths of tubes are also short enough and flexible enough to allow a swimming pool owner to shape multiple tubes around the swimming pool to conform to the shape of swimming pools which may be other than rectangular. In addition, the individual lengths are sufficiently small so as to permit elimination of many of the problems of locating around steps, ladders and diving boards.

The individual tubes are normally provided in predetermined dimensions, as aforesaid, and for purposes of storage and/or transport, can be rolled up and packaged in individual containers. However, in another embodiment of the invention, the inflatable pool deck protective guard could be provided in a much longer length. In this way, the user of the pool can cut the tube to an exact dimension for his or her pool. The cut tubes could then be sealed at their opposite transverse ends by heat or glue by the pool owner. For this purpose, many of the plastics could be provided so that they are heat sealable through the heat of a conventional steam iron or the like. In like manner, many conventional glues can also be provided along with the length of uncut inflatable tube in order to enable the user to easily and conveniently seal the cut edges of the tubes.

The bottom of the inflatable tubes may also be slightly abraded or formed of an abrasive material so as to frictionally engage the upper surface of a swimming pool deck. In like manner, the upper surface of the inflatable tubes could also be slightly abraded or formed of a material causing somewhat of a frictional contact with a user to enable a user of the swimming pool to hold on to the protective guard.

FIGS. 6–10 more fully illustrate the use of the inflatable tubes on structural components or members forming part of or located within the swimming pool. FIGS. 6 and 8, more specifically, illustrate the use of the inflatable tubes on the upper and lower edges of a diving board which is typically and conventionally mounted on a pool deck and extends out over the water in the swimming pool.

Returning now to FIG. 6, it can be observed that a diving board 50 is conventionally mounted on a support 52, which is in turn, secured to a pool deck 54. On the portion of the diving board which is located over the water in the swimming pool, a plurality of the inflatable tubes are mounted on the upper edge of the diving board. It should be understood, however, that the inflatable tubes could extend around the complete periphery of the swimming pool, including the upper and lower edges. These inflatable tubes 56 are essentially similar to the inflatable tubes 20 used on the edges of the pool deck. However, referring to FIG. 8, it can be seen that in this case, the inflatable tubes 56, which include a central air chamber or other inflatable chamber 58, are provided with Velcro strips 60 on their under-surface. These Velcro strips 60 mate with similar Velcro strips 62 on the upper surface of the diving board, and on the outermost edge of the diving board, as best illustrated in FIG. 8.

The Velcro strips 62 may be secured to the surfaces and edges of the diving board by means of suitable adhesives, or they may be tacked or otherwise secured to the diving board in any other conventional manner. Thus, when the inflatable tubes 56 are located in the contact with the diving board, there will be a relatively inexpensive, but yet highly effective, means of absorbing the impact of a swimmer who may swim against the edge of the diving board or who may inadvertently jump against the edge of the diving board.

The inflatable tubes 56 also include a filler valve 64 similar to that employed in the inflatable tubes 20. The construction of remaining portions of the inflatable tubes 56 are similar to the previously described inflatable tubes 20. It should be understood that the filler valves 64 which are used on the inflatable tubes 56 and, for that matter, the filler valves 24 used on the inflatable tubes 20 can all be recessed into the tube after filling of the tubes. In this way, the filler valves would adopt a position where they are flush with the surface of the tube and thereby eliminate any possibility of injury as a result of tripping on or stepping on a filler valve.

FIG. 7 illustrates the use of the inflatable tubes on both the railings and the rungs of a pool ladder 70. The ladder 70 is of a conventional construction and includes a pair of vertically spaced apart rails or legs 72 which are connected by horizontally disposed steps or rungs 74.

In the case of the diving board, a plurality of the endwise abuttable tubes 56 are located on the upper edge and similar tubes 56 are located on the lower edge of the diving board 50, as best illustrated in FIG. 6. In the case of the ladder 70, usually only one or possibly a pair of inflatable tubes are required on each of the legs or rails 72. However, it should be understood that the inflatable tubes could be abuttable against one another and located on the entire length of each of the legs or rails 72. Further, only a single inflatable tube is required on each of the rungs 74, and usually for the forward-most edge of the rungs 74. Thus, in the embodiment of the invention as illustrated in FIGS. 7 and 9, an individual inflatable tube 76 is located on each rung 74 and a plurality of like individual inflatable tubes 77 are located on each of the rails 72.

For purposes of securing the inflatable tubes 76 to the rungs 74 of the ladder, these tubes 76 are also provided with Velcro strips 78, as best illustrated in FIG. 9 and with a construction substantially similar to the inflatable tubes 56. These Velcro strips 78 mate with similar Velcro strips 80 located on the upper and lower surfaces of the rungs and, for that matter, Velcro strips could mate with like Velcro strips on the forward most edge of the rungs 74. While the exact connection of the inflatable tubes to the rails of the ladder have not been illustrated, it should be understood that Velcro strips on the under-surface of the inflatable tubes could be attached to the Velcro strips on ladder rails 72.

FIG. 10 illustrates a slightly modified form of inflatable tube construction 82 which can be used with the structural components associated with or extending into the swimming pool. In this case, the inflatable tube construction 82 includes an inflatable tube 84 substantially similar to the tube 56. A pair of webs or skins 86 are secured to the tube 84 and extend outwardly therefrom in the manner as best illustrated in FIG. 10 of the drawings. In this case, Velcro strips 88 are located at the free ends of each of these webs 86. These Velcro strips 88 on the webs would mate with like Velcro strips 90 on the ladder rungs or other structural components. In this case, it can be observed that the mating Velcro strips 90 are located at the rear edges of the ladder rungs as opposed to forward portions thereof. Further, the webs 86 also provide some degree of protection against impact with the upper and lower surfaces of the ladder rungs 74.

In still other embodiments of the present invention, the individual tubes could be provided with straps secured thereto for purposes of being engaged by the hands of a user. In like manner, the tubes could be formed with hand-held recesses so as to enable a user to hold onto the side of the protective guard.

The individual tubes could easily be inflated, when using air, by hand or foot operated pumps. In like manner, vacuum cleaners and possibly even garden leaf blowers could be used for filling of the individual tubes.

The various tubes which are used in the protective guard assembly are preferably formed of a plastic material such as polyethylene or polypropylene. Further, some rubber could be incorporated into the plastic in order to enable flexibility so that the tubes can be blown and shaped to a proper size. Further, the tubes could be formed by any of a number of conventional plastic molding techniques. Thus, for example, the tubes could be formed through molding or extrusion. The tubes themselves could also have an abraded or rougher surface, as indicated, in order to enable engagement by the hands of a user. Thus, it may be desirable to use a surface abraded tube due to the fact that a wet tube may be difficult to engage and to immediately grasp. In like manner, a cloth or cloth-like surface can be included on the exterior of the tube in order to add to the aesthetics, and also to preclude heat build up in the tube.

It should also be understood that the tubes forming part of the protective guard of the present invention can be formed of various colors and with various design patterns so as to match a desired color combination or color pattern of a surrounding environment. These protective components are also highly effective in that they can be produced at a relatively low cost from relatively simply vinyl plastics in conventional molding and extruding operations. Further, they can be easily moved from one position to another and they can be easily deflated for purposes of storage in small compact units.

Thus, there has been illustrated and described a unique and novel protective guard for extending around the edge of a swimming pool and on structural components associated with a swimming pool to protect the user of the swimming pool and which is relatively inexpensive and easy to install. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by Letters Patent is:

1. A combination of a structural component of a swimming pool and a portable and inflatable protective guard used on such component to protect a swimmer against a hard contact with that component and where such guard extends around a peripheral portion of the structural component of the swimming pool adjacent the edge of the component at the swimming pool, said combination comprising:

a) a structural component of a swimming pool having relatively hard first and second surfaces lying in mutually angular planes which meet at an edge of said member, b) a plurality of individual and separable tubes on said structural component which are individually inflatable and capable of being inflated with a fluid, each of said tubes having opposed ends with an end of one tube being located in endwise abutting engagement with one end of another tube so that said tubes in combination extend around a portion of the edge of the structural component of the swimming pool, c) valve means on each of said tubes to inflate the tubes with a fluid and to deflate the tubes, and d) means connected to each of said tubes to hold said tubes in endwise abutted position with one another when one or more tubes extend around the edge of the structural component at the swimming pool, said tubes having sizes so that in combination they extend around the properly fit over the edge of the swimming pool structural component so as to generally correspond to the size of the area on which the tubes are used, said tubes also having a configuration when inflated to effectively wrap around portions of the angular surfaces of the structural component and any edges between the angular surfaces so as to extend over a portion of said first surface of the structural component and an angularly located portion of the second surface of the structural component and over an edge portion of the structural component, such that the combination provides a protected swimming environment where angulated hard surfaces of the structural component and hard edges therebetween against which a swimmer could impact are covered by resilient tubes to absorb the force of an impact during a swimming activity by a swimmer and to thereby provide a protection to a swimmer in such swimming activity and preclude hard contact of a swimmer against the edge of the component.

2. The combination of claim 1 further characterized in that said component is selected from the class consisting of a diving board, a ladder, a slide, railings, and steps of a pool.

3. The combination of claim 1 further characterized in that attachment means is associated with each of said tubes for attaching the tubes to the structural component at the swimming pool.

4. The combination of claim 3 further characterized in that the attachment means comprises a web attachment to said tube and having an attachment strip connected to said web for attachment to a mating attachment strip on the structural structural component.

5. The combination of claim 4 further characterized in that said attachment means comprises a fiber loop and hook type fastening attachment strip on the tube for engaging a similar loop and hook type fiber fastening attachment strip of the structural component.

6. The combination of claim 3 further characterized in that the attachment means comprises an attachment strip on the tube and a mating attachment strip on the structural component.

* * * * *